United States Patent [19]

Whatley

[11] Patent Number: 5,005,299

[45] Date of Patent: Apr. 9, 1991

[54] SHOCK ABSORBING OUTSOLE FOR FOOTWEAR

[76] Inventor: Ian H. Whatley, 926 Cleveland St., Apt. F-101, Greeville, S.C. 29601

[21] Appl. No.: 478,476

[22] Filed: Feb. 12, 1990

[51] Int. Cl.[5] ..... A43B 13/00

[52] U.S. Cl. ..... 36/25 R; 36/27; 36/28; 36/34 R; 36/35 R

[58] Field of Search ..... 36/25 R, 27, 28, 32 R, 36/69, 102, 107, 108, 114

[56] References Cited

U.S. PATENT DOCUMENTS

| | | | |
|---|---|---|---|
| 2,885,797 | 5/1959 | Chrencik | 36/2.5 |
| 2,887,794 | 5/1959 | Masera | 36/25 R |
| 3,100,354 | 8/1963 | Lombard et al. | 36/25 R |
| 3,793,750 | 2/1974 | Bowerman | 36/59 |
| 3,808,713 | 5/1974 | Dassler | 36/32 |
| 3,818,618 | 6/1974 | Dassler | 36/32 |
| 4,043,058 | 8/1977 | Hollister et al. | 36/102 |
| 4,085,527 | 4/1978 | Riggs | 36/114 |
| 4,094,081 | 6/1978 | Reiner et al. | 36/116 |
| 4,096,649 | 6/1978 | Saurwein | 36/32 |
| 4,128,950 | 12/1978 | Bowerman et al. | 36/30 |
| 4,259,792 | 4/1981 | Halberstadt | 36/28 |
| 4,266,349 | 5/1981 | Schmohl | 36/32 |
| 4,271,606 | 6/1981 | Rudy | 36/29 |
| 4,281,467 | 8/1981 | Anderie | 36/32 R |
| 4,297,796 | 11/1981 | Stirtz et al. | 36/28 |
| 4,546,556 | 10/1985 | Stubblefield | 36/32 R |
| 4,680,875 | 7/1987 | Danieli | 36/25 R X |
| 4,697,361 | 10/1987 | Ganter et al. | 36/28 |
| 4,730,402 | 3/1988 | Norton et al. | 36/32 R X |
| 4,741,114 | 5/1988 | Stubblefield | 36/114 X |

FOREIGN PATENT DOCUMENTS

| | | | |
|---|---|---|---|
| 89/11047 | 11/1989 | World Int. Prop. O. | 36/28 |

*Primary Examiner*—Paul T. Sewell
*Assistant Examiner*—Beth Anne Cicconi
*Attorney, Agent, or Firm*—Fish & Richardson

[57] ABSTRACT

An outsole for an item of footwear. The outsole is provided with a lower surface having a central portion and a peripheral portion. Also provided are a plurality of resilient shock absorbing strike plates which extend from, and are disposed about, the peripheral portion to define a central cavity disposed below the central portion. Each strike plate has an inwardly sloped wall adjacent the central concavity. This sloped wall is disposed at an obtuse angle to the central portion. Also provided is an elastic membrane connecting a plurality of the strike plates and extending through the central concavity. The membrane has a stiffness less than that of one of the strike plates to which it is connected.

16 Claims, 5 Drawing Sheets

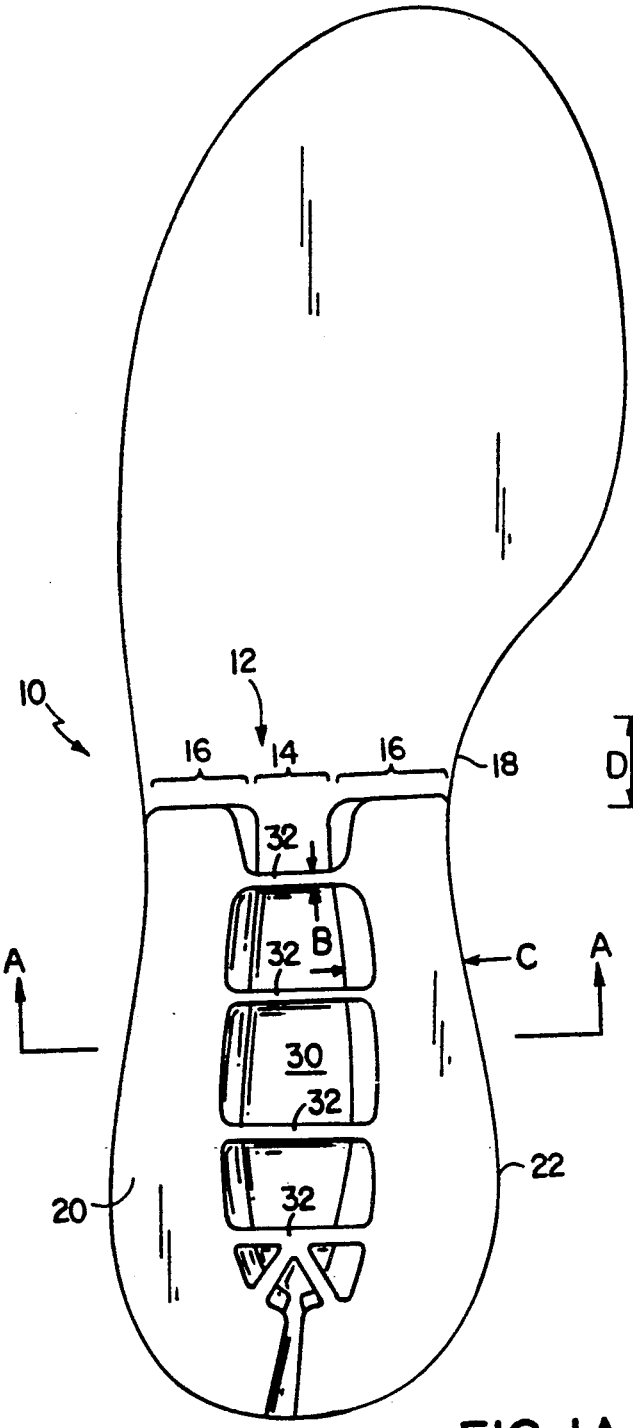
FIG. 1A
FIG. 1B
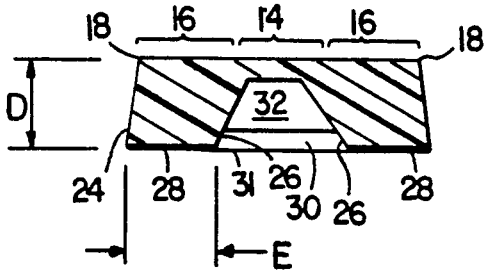

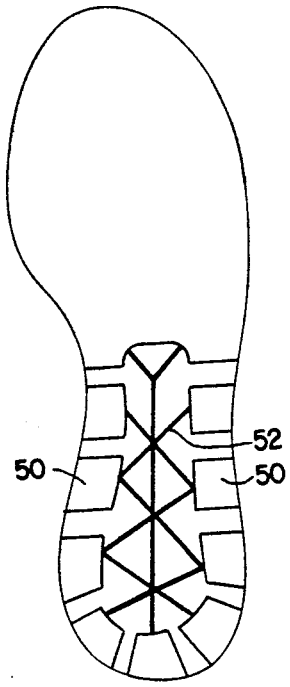
FIG. 3A
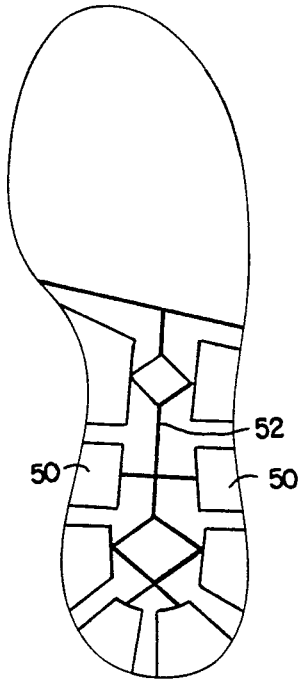
FIG. 3B
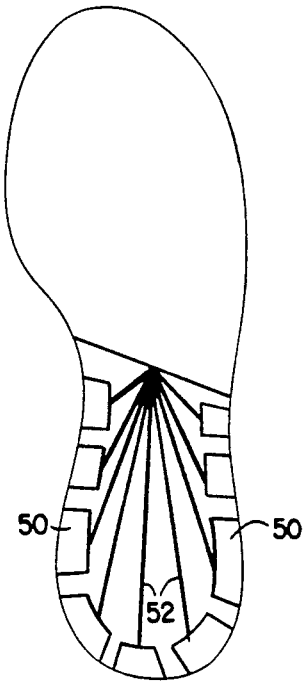
FIG. 3C
FIG. 4A
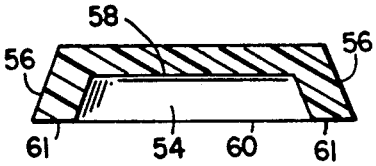
FIG. 4B
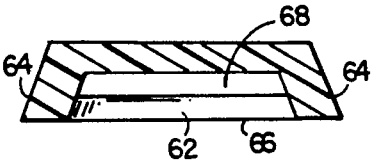
FIG. 4C
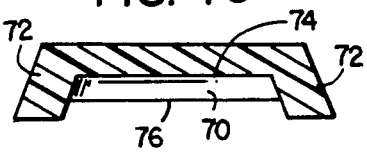
FIG. 5A
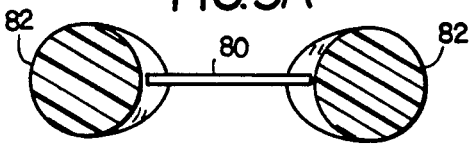
FIG. 5B
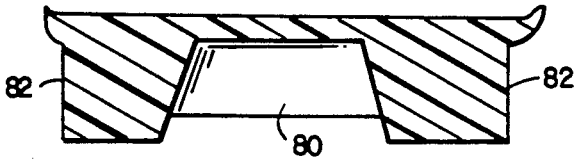

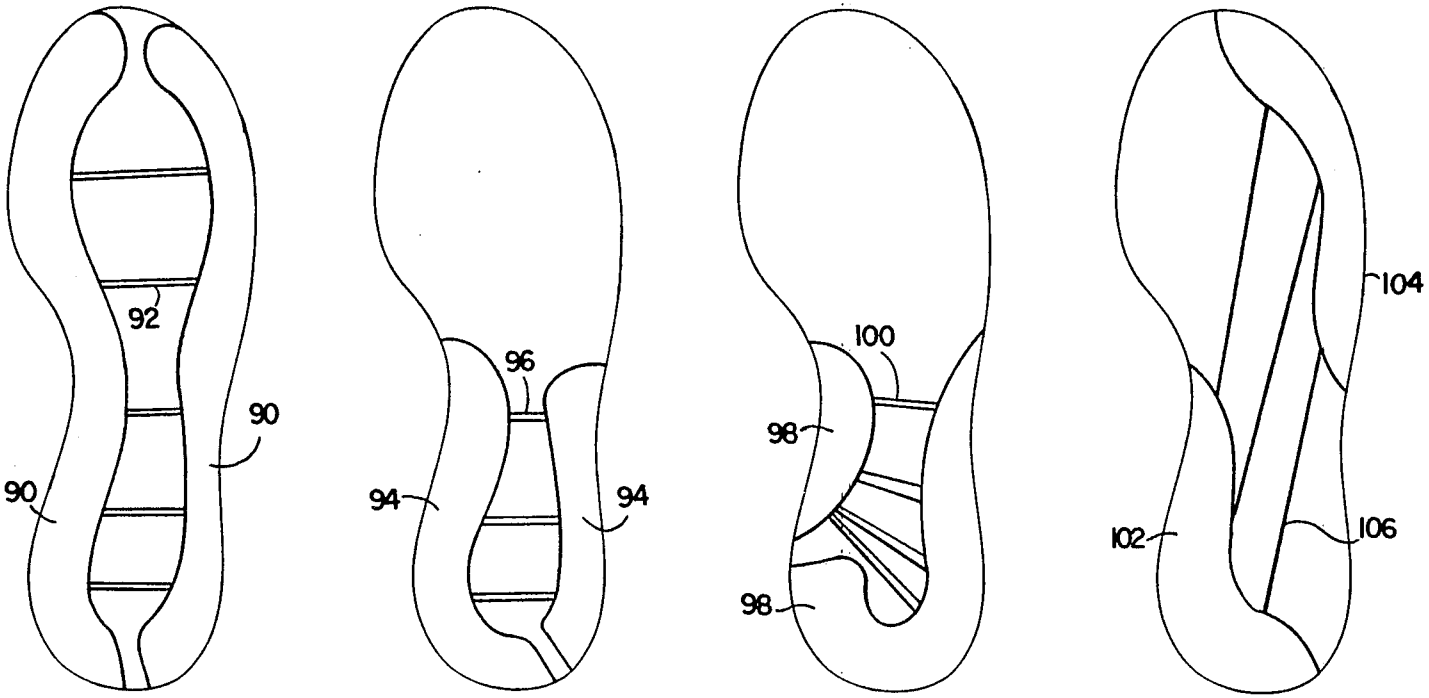
FIG. 6A
FIG. 6B
FIG. 6C
FIG. 6D
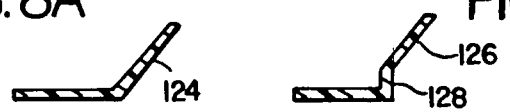
FIG. 8A
FIG. 8B
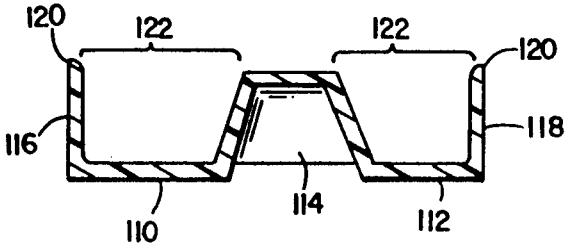
FIG. 7

SHOCK ABSORBING OUTSOLE FOR FOOTWEAR

BACKGROUND OF THE INVENTION

This invention relates to outsoles for footwear.

Stubblefield, U.S. Pat. Nos. 4,372,058, 4,546,556, 4,550,510, and 4,449,307 describes an outsole for an athletic shoe. The outsole is provided with several outwardly disposed flexible lugs inclined at an obtuse angle to the lower surface of the shoe sole. This angular configuration allows the lugs to spread outwardly upon impact with the ground and thereby dissipate impact forces away from the foot and leg of the wearer. A series of lugs is formed around the periphery of the shoe sole to define a central concavity in which further lugs may be located. These further lugs have a lesser vertical dimension than the outermost lugs. In order to prevent the outermost lugs from being broken, a reinforcing means may be provided as a web extending between adjacent lugs. This web extends around the periphery of the outsole to connect adjacent lugs. It does not extend within the central concavity. The shoe sole also may be provided with a shock absorbing inner portion (distinct from the outsole) in which a plurality of parallel tranverse walls extend vertically upward.

SUMMARY OF THE INVENTION

The invention features an outsole for an item of footwear. The outsole is provided with a lower surface having a central portion and a peripheral portion. Also provided are a plurality of resilient shock absorbing strike plates which extend from, and are disposed about, the peripheral portion to define a central cavity disposed below the central portion. Each strike plate has an inwardly sloped wall adjacent the central concavity. This sloped wall is disposed at an obtuse angle to the central portion. Also provided is an elastic membrane connecting a plurality of the strike plates and extending through the central concavity. The membrane has a stiffness less than that of one of the strike plates to which it is connected.

In preferred embodiments the central concavity is oriented lengthwise; the strike plates have outwardly sloped walls; a pair of strike plates and a membrane are on the form of an A-frame; the strike plates are located in the heel region of the outsole; the membrane extends from the central portion; the membrane extends to an edge of the central concavity defined by a plane extending from that portion of a plurality of the strike plates furthest from the peripheral portion; two strike plates are provided on the outsole and are connected together by more than one membrane; the membrane has a thickness in at least one dimension of less than the transverse width of one of the strike plates to which it is connected; the strike plates are disposed in the medial and lateral region of the sole; the strike plates have a generally flat surface spaced from the peripheral portion and are adapted to cause all of the flat surface to contact the ground during use; the membrane is adapted to absorb, by extension, at least a portion of a vertical force applied to a strike plate; the strike plates extend from the peripheral portion at least 1.5–10.0 millimeters; the outerwall of the strike plate forms an angle with the peripheral portion of between 0° and 15° inclusive; and the strike plates extend inwardly at least 1 centimeter from the edge of the peripheral portion.

Applicant has discovered that a superior outsole can be created by provision of an elastic membrane extending between two peripherally located strike plates. Such a membrane acts to absorb a significant portion of a vertical force applied to the strike plates. Because the force is absorbed by extension of the membrane the efficiency of shock absorption is great. Such construction allows provision of a strike plate with a flat or planar surface to allow maximal contact with the ground, and thus maximal friction between the ground and the outsole. In addition, the strike plates can be formed with wide dimensions and of dense material to thereby increase the life of the outsole. Such strike plates are less likely to break during use.

Generally, an outsole of this invention is suitable for use with a shoe, and particularly shoes used in activities such as running, walking, or other sport activities where landing and/or propulsive shock is created during use. Footstrike which takes place during these activities is associated with numerous injuries to athletes. In addition, a large amount of kinetic energy is dissipated during footstrike. The present invention provides an outsole which enhances shock absorption during contact of the shoe with the ground during use, thereby reducing injury to a user. In addition such outsoles, can store the kinetic energy of such ground contact in the shoe sole for return to the athlete at the pushoff phase of locomotion. That is, as the foot strikes the ground the membrane contacting two strike plates is caused to extend, and as the foot is lifted from the ground, the membrane springs back to its former length and thereby returns the stored energy to the athlete. This allows more efficient use of an athlete's energy.

Other features and advantages of the invention will be apparent from the following description of the preferred embodiments thereof, and from the claims.

DESCRIPTION OF THE PREFERRED EMBODIMENTS

The drawings will first briefly be described.

Drawings

FIG. 1A is a generally isometric view of an outsole of this invention; FIG. 1B is a sectional view at A—A of the outsole shown in FIG. 1A;

FIGS. 3A–3C are diagrammatic representations of membranes connecting strike plates;

FIGS. 4A–4C are sectional views of various membrane constructions;

FIGS. 5A and 5B are a plan view and sectional view through cleats connected by an elastic membrane;

FIGS. 6A–6D are diagrammatic representations of strike plate and membrane constructions;

FIG. 7 is a transverse sectional view of a strike plate designed to allow ready attachment of the outsole to a midsole of a shoe;

FIGS. 8A and 8B are sectional representations of an angled wall of a strike plate.

STRUCTURE

Figure 2:
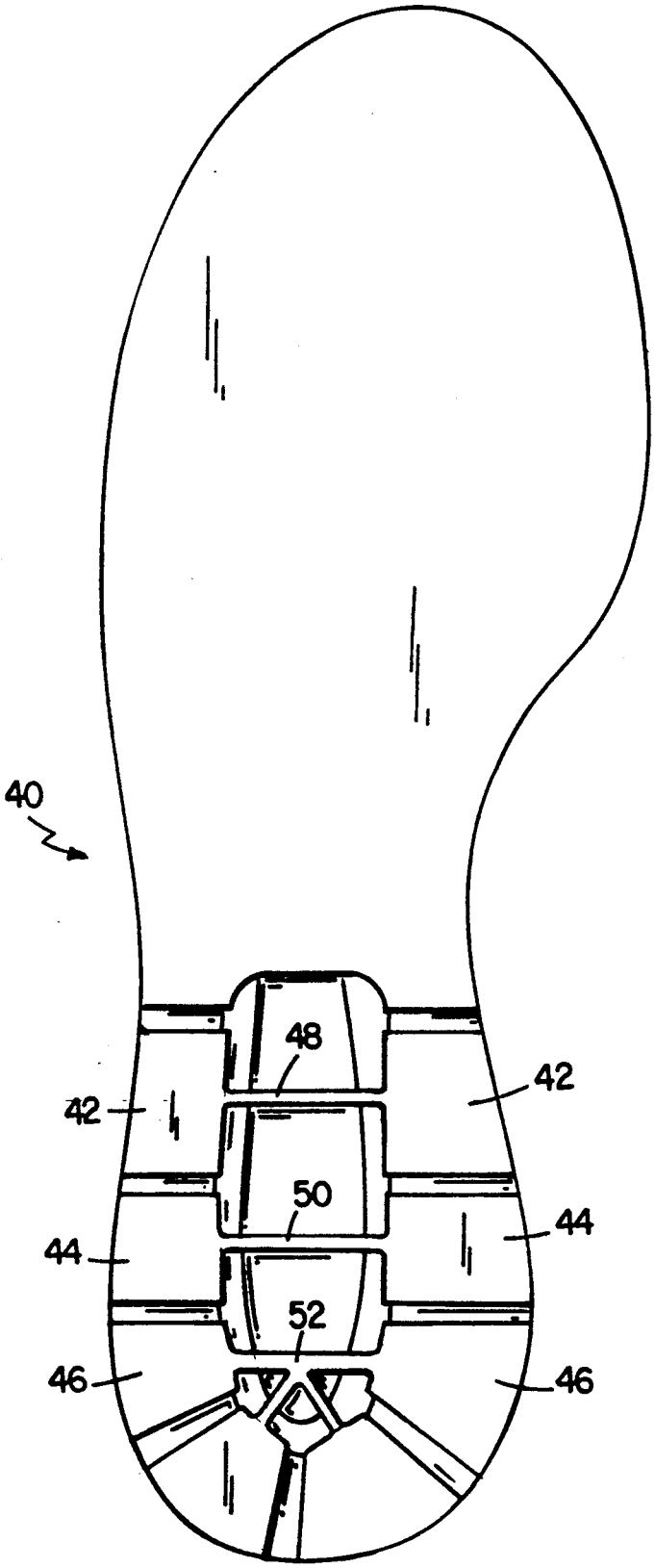
FIG. 2 is a generally isometric view of an outsole.

Referring to FIGS. 1A and 1B, outsole 10 has a lower surface 12 having a central portion and peripheral portion generally shown by bracketed regions 14 and 16, respectively. Peripheral portion 16 is a region of the lower surface adjacent the whole of perimeter 18 of sole 10. Central portion 14 is the region surrounded by peripheral portion 16. Also provided are two strike plates 20 and 22 extending vertically downward from peripheral portion 16. Each strike plate has an outer wall 24 extending from perimeter 18, and an inner angled wall 26 extending generally from the junction of peripheral portion 16 and central portion 14. Angled walls 26 are formed at an obtuse angle $\alpha$ to lower surface 12. This angle is generally between 95° and 135°. Each strike plate has a generally planar (or flat) surface 28 spaced from peripheral portion 16 and adapted to contact qround during use of the outsole. Such a planar surface may be provided with dimples or other fine indentations to provide more friction with the ground. In this invention, however, such dimples or ridges are included in the term "planar surface".

Strike plates 20 and 22 together define a central concavity 30 disposed above central portion 14 and between the strike plates. It extends to a plane 31 defined by surfaces 28. Angled walls 26 are adjacent central concavity 30. Strike plates 20 and 22 extend from peripheral portion 16, a distance D of at least 1.5 millimeters, preferably between 0.5 and 1.5 centimeters. In addition, the strike plates extend inwardly from perimeter 18, a distance E, preferably between 0.5 and 1.5 centimeters, most preferably at least one centimeter.

Also provided in outsole 10 are a plurality of elastic membranes 32 connecting strike plates 20 and 22 and extending through central concavity 30. Membranes 32 are formed of material having a lesser stiffness than that of one of the strike plates to which they are connected. In addition, membranes 32 are formed of a thickness in at least one dimension, e.g., shown by arrow B, which is less than the transverse width C of one of strike plates 20 and 22 to which the membrane is connected.

Central concavity 30 in outsole 10 is generally lengthwise oriented in the heel region of the outsole, and the pair of strike plates and membrane together form an A shape.

Figure 9A:
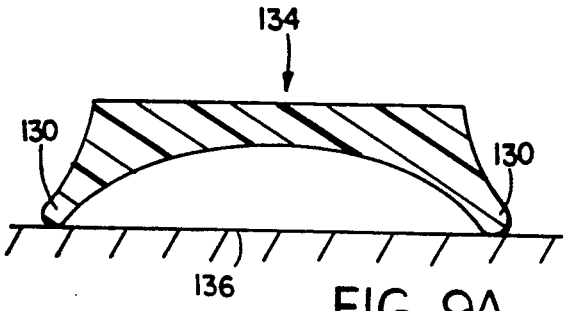
FIGS. 9A–9D are diagrammatic representations of shock absorption by outsoles of differing construction.
Figure 9C:
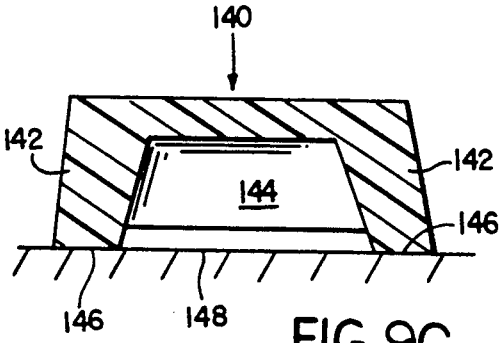
Figure 9B:
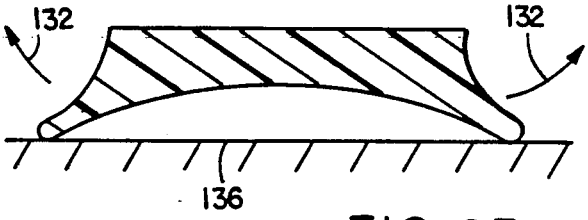
Figure 9D:
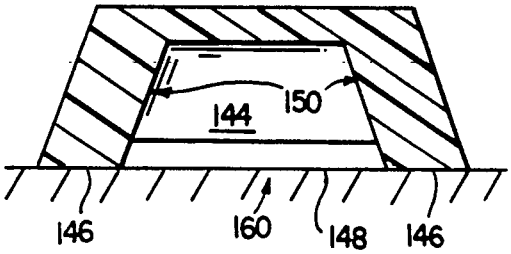

Referring to FIGS. 9A–9D there is shown the effect of a force applied to an outsole. In FIGS. 9A and 9B the outsole has a pair of outwardly angled lugs 130 which are caused to bend (as shown by arrows 132) when a force 134 is applied and the lugs are contacted with ground 136. Force 134 is moderately absorbed by bending of lugs 130. In FIGS. 9C–9D, when a force 140 is applied to an outsole of the present invention, e.g., to a pair of strike plates 142 (having a planar surface 146) connected together by a membrane 144, force 140 is absorbed by extension of membrane 144, as shown by arrows 150. During such extension, strike plates 146 remain in contact with qround 148 and the energy of force 140 is stored within membrane 144. When force 140 is released, membrane 144 regains its original shape and exerts an upward force (shown by arrow 160) away from ground 148. It is this property that provides the advantages of the present invention.

The above described outsole may be formed from any standard footwear material. The membrane may be of any elastic material, for example, rubber (synthetic or natural) or polymer such as PVC, PU, Nylon, Surlyn, Hytrel or metal. The angled walls of the strike plates may be of any material which is stiffer than such a membrane. The membrane and angled walls may be made of the same material so long as the membrane has at least one dimension which is thinner than a transverse section of a strike plate. The strike plates may be formed from a different material on their surfaces and their inner portions. For example, the surface may be formed of any standard outsole material and the inner portion formed of foam. In this way the outsole may first be molded and then foam applied to its upper surface. The outsole may be manufactured by any standard procedure.

Other Embodiments

Other embodiments are within the following claims. For example, referring to FIG. 2, outsole 40 is provided with pairs of strike plates 42, 44, and 46, each connected by one or more membranes 48, 50, and 52, respectively. This construction is similar to the outsole in FIG. 1, but has relatively large strike plates 20 and 22 separated into smaller strike plates. Such construction provides better outsole to surface contact in moist conditions, or when the ground contains many small particles, e.g., rotten fruit.

Referring to FIGS. 3A, 3B, and 3C, there are shown various patterns by which strike plates 50 can be connected by membranes 52. Connecting membranes of this invention must merely connect any two points or strike plates which are caused to move apart when a vertical or near vertical force is applied to the strike plates.

FIGS. 4A, 4B, and 4C show various membrane designs suitable in this invention. In FIG. 4A, a membrane 54 connects strike plates 56 from the base of central portion 58 to a plane 60 defined by planar surfaces 61 of strike plates 56. Referring to FIG. 4B, a membrane 62 extends between two strike plates 64, from a plane 66 defined by a planar surface of strike plates 64, and extends through only a portion of central concavity 68. Referring to FIG. 4C, membrane 70 extends between two strike plates 72 from central portion 74 to a level plane within central cavity 76.

Referring to FIGS. 5A and 5B there is shown an example of a membrane 80 connecting a pair of cleats 82, for example cleats used on athletic shoes used for football or soccer. Cleats 82 are the equivalent of a strike plate discussed above.

Referring to FIGS. 6A, 6B, 6C, and 6D there are shown examples of variations of the shape of striking surfaces and connecting membranes. In FIG. 6A, strike plates 90 extend the length of an outsole, and connecting membranes 92 extend transversely between the strike plates. In FIG. 6B, strike plates 94 are provided only in the heel region of the outsole, and membranes 96 are provided in a transverse direction between these strike plates. In FIG. 6C, strike plates 98 also extend only in the heel region of an outsole but one such strike plate extends around the whole of the end of the heel. These strike plates are connected by membranes positioned at various angles to the longitudinal axis of the outsole. In FIG. 6D, strike plates 102 and 104 are located partially in the heel region and partially in the toe region of the outsole, and are connected by generally longitudinally aligned membranes 106.

Referring to FIG. 7 there is shown a transverse section of an outsole having a pair of strike plates 110 and 112 connected together by a membrane 114. Strike plates 110 and 112 are formed with outer edges 116 and 118 extending from a peripheral edge 120 of the outsole at a right angle to peripheral region 122. Such strike plate construction on an outsole permits easier attachment of an upper or midsole to the outsole.

Referring to FIGS. 8A, and 8B, there are shown examples of inwardly angled walls of a strike plate. In FIG. 8A an inwardly angled wall 124 is formed as a regular angled portion, whereas in FIG. 8B inwardly angled wall 126 is provided with a short vertical extension 128.

I claim:

1. An outsole for an item of footwear, comprising:

a lower surface of said outsole having a central portion and a peripheral portion, a plurality of resilient shock absorbing strike plates extending from and disposed about said peripheral portion to define a central concavity disposed below said central portion, each said strike plate having an inwardly sloped wall adjacent said central concavity, said sloped wall being disposed at an obtuse angle to said central portion, and an elastic membrane depending from said lower surface connecting a plurality of said strike plates and extending through said central concavity, said membrane having a stiffness less than that of one of the strike plates to which it is connected.

2. The outsole of claim 1 wherein said central concavity is oriented lengthwise along said outsole.

3. The outsole of claim 1 wherein a said strike plate has an outwardly sloped wall.

4. The outside of claim 1 wherein a pair of said strike plates and a membrane are in the shape of an A.

5. The outside of claim 1 wherein said strike plate and said membrane are located in the heel region of said outsole.

6. The outsole of claim 1 wherein said membrane extends from said central portion.

7. The outsole of claim 1 wherein said membrane extends to an edge of said central concavity defined by a plane extending from that portion of a plurality of said strike plates furthest from said peripheral portion.

8. The outsole of claim 1 wherein two strike plates are provided and more than one membrane connects said strike plates.

9. The outsole of claim 1 wherein said membrane has a thickness in at least one dimension of less than the transverse width of one of said strike plates to which it is connected.

10. The outsole of claim 1 wherein said strike plates and said membrane are disposed in the medial and lateral region of said outsole.

11. The outsole of claim 1 wherein said strike plates have a generally flat surface spaced from said peripheral portion and adapted to cause all of said flat surface to contact ground during use of said outsole.

12. The outsole of claim 1 wherein said membrane is adapted to absorb by extension a portion of a vertical force applied to a strike plate.

13. The outsole of claim 1 herein said strike plates extend from said peripheral portion by at least 1.5 millimeters.

14. The outsole of claim 1 wherein the outer surface of a said strike plate defines an outerwall of said strike plate said outer wall forming an angle with said peripheral portion of between 0° to 15° inclusive.

15. The outsole of claim 1 wherein a said strike plate extends inwardly at least one centimeter from the edge of said peripheral portion.

16. An outsole for an item of footwear, comprising:

a lower surface of said outsole having a central portion and a peripheral portion, a plurality of resilient shock absorbing stroke plates extending from and disposed about said peripheral portion to define a central concavity disposed below said central portion, each said stroke plate having an inwardly sloped wall adjacent said central concavity, said sloped wall being disposed at an obtuse angle to said central portion, and an elastic membrane separate from said lower surface connecting a plurality of said strike plates and extending through said central concavity, said membrane having a stiffness less than that of one of the stroke plates to which it is connected.

* * * * *